US005403474A

United States Patent [19]

Emery

[11] Patent Number: 5,403,474

[45] Date of Patent: Apr. 4, 1995

[54] CURB INLET GRAVEL SEDIMENT FILTER

[76] Inventor: Grant R. Emery, 2423 Gilpin St., Denver, Colo. 80205

[21] Appl. No.: 201,194

[22] Filed: Feb. 24, 1994

[51] Int. Cl.[6] ..... E03F 5/14

[52] U.S. Cl. ..... 210/163; 210/282; 210/474; 210/484; 210/470; 404/4

[58] Field of Search ..... 210/163, 164, 291, 473, 210/282, 474, 470, 477, 483, 484, 485; 404/2, 3, 4, 5

[56] References Cited

U.S. PATENT DOCUMENTS

| | | | |
|---|---|---|---|
| 232,948 | 10/1880 | Dernham | 210/163 |
| 809,201 | 1/1906 | Lutz | 404/4 |
| 965,832 | 7/1910 | Nicholas | 210/163 |
| 1,060,338 | 4/1913 | Gschwind | 210/164 |
| 1,245,903 | 11/1917 | Gross | 210/163 |
| 1,654,247 | 12/1927 | Egan | 210/164 |
| 2,182,795 | 12/1939 | Day | 210/164 |
| 2,550,400 | 4/1951 | Boosey | 210/163 |
| 4,419,232 | 12/1983 | Arntyr | 210/164 |
| 4,594,157 | 6/1986 | McGowan | 210/163 |
| 4,935,132 | 6/1990 | Schaier | 210/163 |
| 5,133,619 | 7/1992 | Murfae | 404/4 |
| 5,223,154 | 6/1993 | MacPherson et al. | 210/163 |
| 5,232,587 | 8/1993 | Hegemier | 210/162 |
| 5,284,580 | 2/1994 | Shyh | 210/163 |

FOREIGN PATENT DOCUMENTS

| | | | |
|---|---|---|---|
| 223036 | 10/1921 | United Kingdom | 210/163 |

OTHER PUBLICATIONS

"Inlet Sediment Filters" Douglas County Erosion Control Criteria, p. 46 (1987).

*Primary Examiner*—Peter A. Hruskoci
*Assistant Examiner*—Robert James Popovics
*Attorney, Agent, or Firm*—Scott L. Terrell

[57] ABSTRACT

A portable curb inlet sediment filter which has a box filter frame and a primary baffle panel defining a filter chamber, to be filled with a particulate filter medium, such as gravel, for sediment removal, and an overflow chamber. The overflow chamber has at least one overflow baffle panel in order to provide a hydraulic opening and a peripheral end cap chamber. The end cap chamber is gravel filled in order to clarify water escaping around the front of the frame and into the hydraulic opening through the side panel. The filter frame and baffle panels are a mesh construction having apertures smaller in size than the particles of gravel to be contained.

9 Claims, 2 Drawing Sheets

CURB INLET GRAVEL SEDIMENT FILTER

BACKGROUND OF THE INVENTION

1. Field of the Invention

This invention relates to a portable stormwater sediment filter which can be used adjacent to the street or curb inlet of a conventional storm drainage basin.

2. Description of the Prior Art

Unfiltered stormwater runoff is collected through the recessed curb or street inlets of storm sewer drainage basins. In large development sites, sediment laden stormwater is generated from construction erosion and is a major pollutant. Thus, builders and developers must meet, as part of the overall development plan, erosion control restrictions which require sediment removal at the curb inlet.

The prior art discloses sediment filters which combine cinder blocks, wire screen and gravel. Cinder block and gravel filters are constructed, in situ, by placing a single cinder block adjacent to the curbside at each end of the inlet throat projecting outwardly so that the hollow channel openings run parallel to the curbside. A 2×4 inch wood stud is placed adjacent to, and along the entire span of the inlet throat so that the ends of the wood stud are secured by extension through the hollow channels of the cinder blocks. Additional cinder blocks are then set end-to-end lengthwise against the wood stud along the full span of the inlet throat so that the hollow channels are capable of receiving a horizontal flow of unfiltered water. The wood stud thus serves to create an overflow gap between the inlet throat and the cinder blocks in order to prevent ponding and flooding. Wire screen is located around the perimeter of the cinder blocks in order to prevent movement of a coarse gravel filter medium piled around the perimeter of the wire screen. Unfiltered runoff permeates downstream toward the inlet throat through the gravel, for sediment removal, into the hollow channels of the cinder blocks, over the wood stud, and into the inlet throat of the sewer basin. During periods of high runoff volume, excess water pours over the gravel and cinder block assembly through the gap created by the wood stud. Filters constructed in this manner require technical ability in their construction, are hazardous because the assembly projects into the traffic flow, and necessitate frequent repair because the curbside gutter support is often nonhorizontal, causing the cinder blocks to tip or collapse into the inlet when subject to ponding or flooding conditions.

Another prior art design utilizes straw bales staked tightly within a 4 inch soil trench cleared around the perimeter of the inlet. The bales must be abutting with no gaps, and the trench is backfilled around the outside perimeter of the straw bales. Straw bale filters, however, cannot be used on a paved or concrete support surface, are easily damaged, and the assembly is labor intensive.

Sediment filters, with or without a dischargeable filtration media, have been described in certain U.S. patents. For example, Heggemier et al., U.S. Pat. No. 5,232,587, shows a planer filter resting on angle iron supports fixed inside of a storm sewer basin. A perforated aluminum sediment filter is riveted to a tubular steel frame, a weir and hydraulic opening for flow conveyance is provided adjacent to the filter and a grate-type rack is constructed across the hydraulic opening which serves as an overflow. Lutz, U.S. Pat. No. 809,201, discloses a removable wire basket sediment filter disposed inside an underground sewer basin. Unfiltered surface water passes through a vertical screened opening in order to remove sediment. A subsidiary screened outlet allows water to escape around the basket when the basket is full of sediment. Murfae, et al., U.S. Pat. No. 5,133,619, discloses a removable metal filter basket housed in a basin disposed in an alternative runoff path upstream from the stormwater receiving basin. The basket contains a dischargeable filtration media and lifting channels which enable the basket to be removed from the basin by the tines of conventional waste disposal vehicles. Designs of this type are of a permanent nature, costly to implement, require removal from the sewer basin for cleaning, and are not easily adopted to inlets of varying dimensions.

SUMMARY OF THE INVENTION

The portable street or curb inlet sediment filter disclosed herein is characterized by the fact that it is self-contained for temporary erosion control, easily adapted to different inlet sizes, fits safely and securely adjacent to the curbside, and is designed for ease of installation and maintenance.

The filter comprises a mesh box filter frame having a rectangular bottom panel, a rectangular front panel, a rectangular back panel and two side panels. A mesh primary baffle panel divides the filter frame into a filter chamber, containing a particulate filter medium, such as gravel, and an overflow chamber. The overflow chamber is peripherally divided into a hydraulic opening and one or two end cap chambers by a mesh overflow baffle panel(s). When a single filter is sufficient to span narrow inlets, two overflow baffle panels are used and both end cap chambers are also filled with the filter medium in order to catch sediment from water escaping around the front panel and into the hydraulic opening through the side panels. The present invention also contemplates a plurality of filters, having a single end cap chamber, rigidly attached, side panel to side panel, across the full span of wider inlets. In this manner, only the end cap chambers at each terminal end of the inlet contain filter medium.

The filter frame includes a design for use when a conventional gutter is the support surface. In this instance, the lower ends of each side panel are constructed at an acute angle to the back panel vertical plane, in order to complement the slope of the gutter, so that the upper edge of the side panel remains horizontal when the filter is in use. Where the filter is to be installed on a horizontal support, such as a street, the filter frame is designed with the lower ends of the side panels constructed perpendicular to the back panel vertical plane.

While all panels of the filter may be constructed of a mesh rust-resistant material of sufficient rigidity, the filter is preferably designed so that it consists merely of two shaped parts, that is, plastic injection molded parts, which furthermore can be put together in a simple manner. This means that this filter,provides a basis for economical mass production and for assembly in the best possible way.

BRIEF DESCRIPTION OF THE DRAWINGS

Further details are explained below with the help of the example(s) illustrated in the drawings in which.

DESCRIPTION OF THE PREFERRED EMBODIMENT

Figure 1:
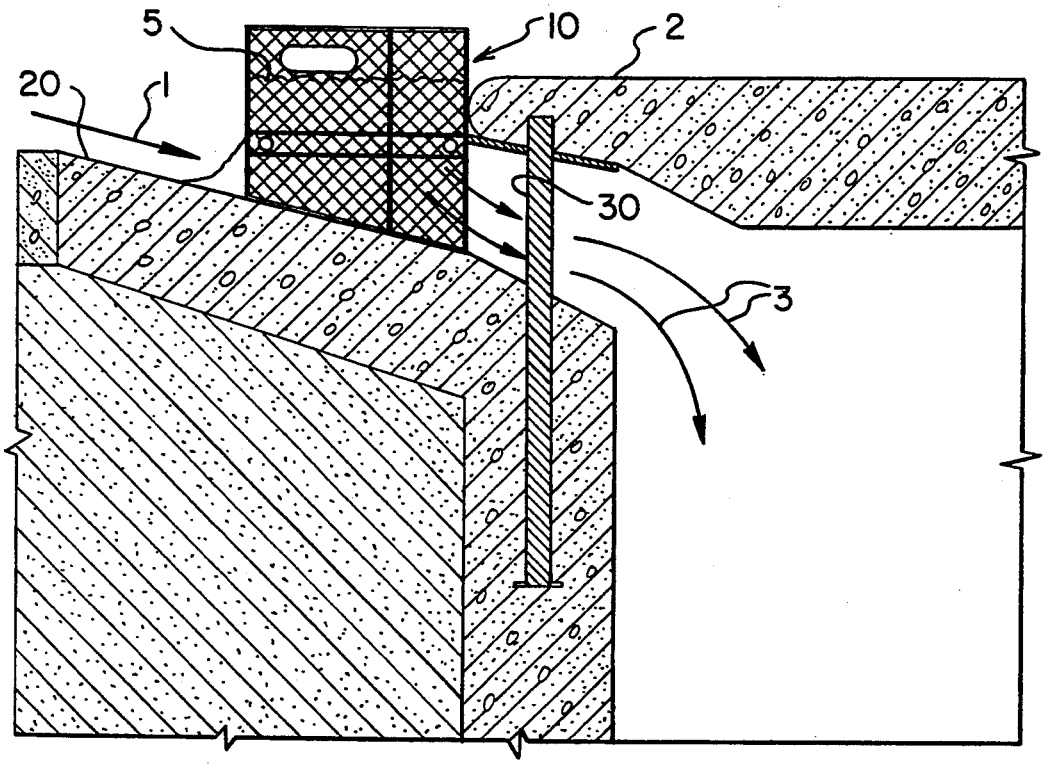
FIG. 1 is a side elevation view of the filter assembly installed on a curbside gutter adjacent to a storm sewer basin inlet.

As shown in FIG. 1, filter frame 10 rests on curbside gutter 20 adjacent to stormwater sewer basin curb inlet 30. Sediment laden stormwater passes downstream along gutter 20 in direction 1 and into filter frame 10. Stormwater permeates through a filter medium, such as coarse gravel 5, contained to the height of curb line 2, in filter frame 10 to effect sediment removal. Clarified stormwater passes out of filter frame 10 in direction 3, and is collected in sewer basin inlet 30.

Figure 3:
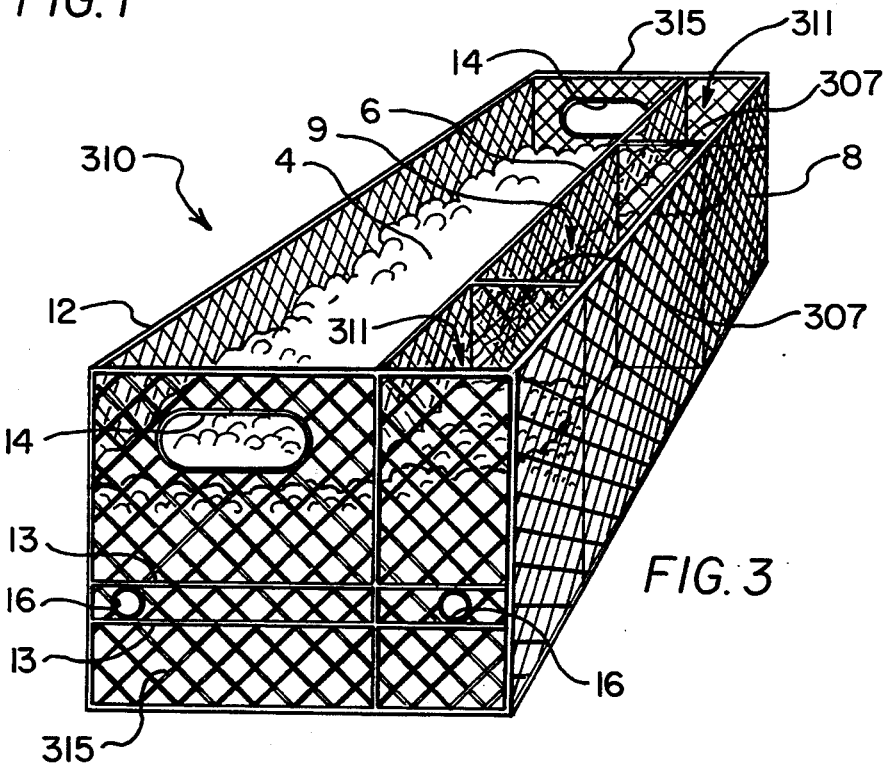
FIG. 3 is a perspective view of the filter frame designed for installation on a horizontal surface.
Figure 2:
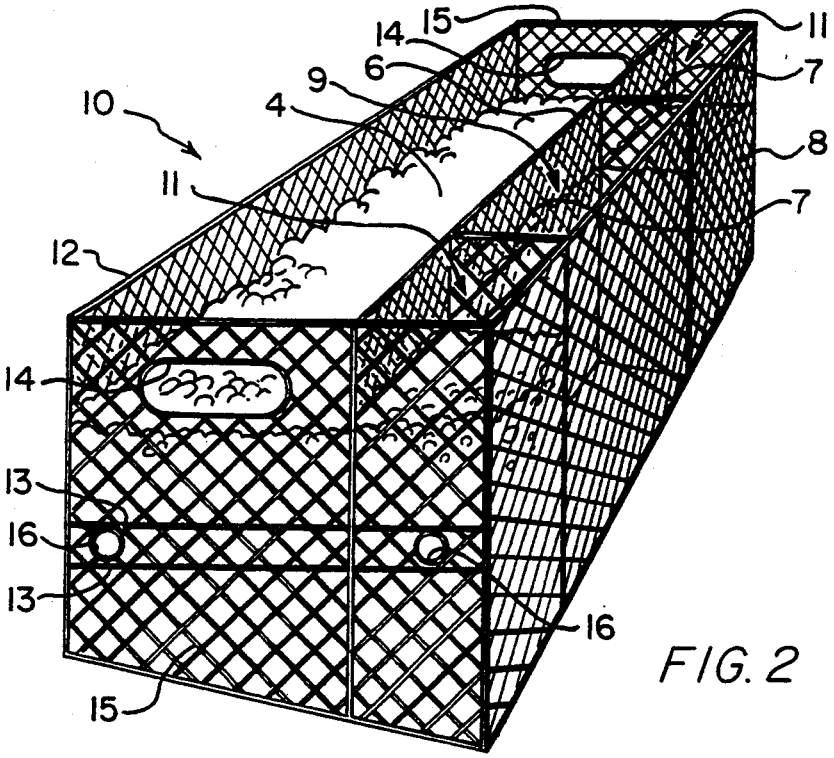
FIG. 2 is a perspective view of the filter frame designed for installation on a non-horizontal gutter.

As shown in FIGS. 2 and 3, mesh primary baffle panel 6 retains coarse gravel particles in filter chamber 4, in order to maintain an unobstructed conveyance of stormwater into inlet 30 (FIG. 1). Two mesh overflow baffle panels 7, 307 each rigidly connected between primary baffle 6 and back panel 8 provide a hydraulic opening 9 and two end cap chambers 11, 311. The end cap chambers 11, 311 are key to the adaptability of the invention to inlets of different sizes. Where a single filter frame is sized sufficient to span the inlet, each end cap chamber 11, 311 is gravel filled to curb line 2 (FIG. 1) in order to remove sediment from stormwater escaping around front panel 12 and into hydraulic opening 9 through side panels 15, 315. Where the filter is to be supported on a curbside gutter, bottom edge of each side panel 15 is at a 75–82 degree angle to the vertical plane of back panel 8, in order to complement the angle of the gutter (FIG. 2).

Filter frame 10, 310 is preferably 24–36×12×12 inches with primary baffle panel 6, disposed in a parallel spaced relationship, 8 inches from front panel 12. Each overflow baffle panel 7, 307 is preferably disposed 6 inches inward from each respective side panel 15, 315 whereby two end cap chambers 11, 311 having a 6×4×12 inch dimension are formed. Each panel is a mesh construction having apertures smaller in size than the particles of gravel, preferably $\frac{1}{4}$–$\frac{1}{2}$ inch square.

Figure 4:
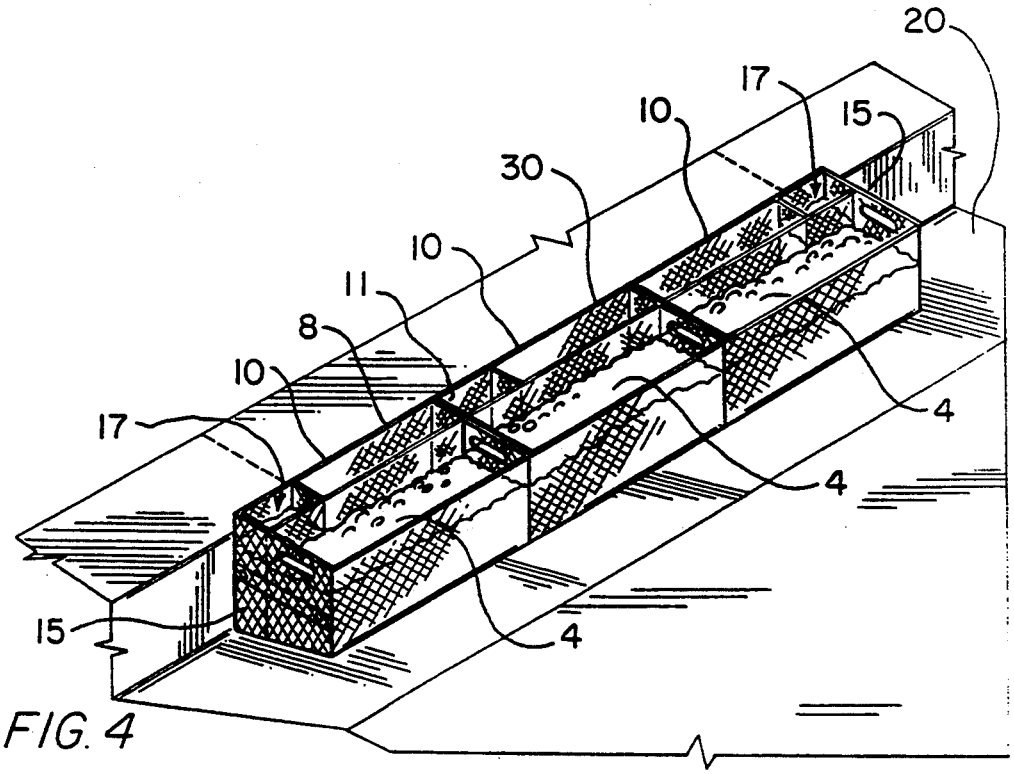
FIG. 4 shows schematically the installation of a plurality of filters, having a single end cap chamber, in order to cover inlets wider in span than a single filter frame.

In FIGS. 2 and 3, aperture 14 is so oriented in side panel 15, 315 that the lower edge thereof remains above curb line 2 (FIG. 1) when the filter is in use. Aperture 14 is preferably oriented equidistant between front panel 12 and primary baffle panel 6. Aperture 14 is sized to form a handle between the upper edge of side panel 15, 315 and the upper periphery of aperture 14, in order to easily lift the filter frame at a point nearest to the center of gravity when filter chamber 4 is gravel filled. Two transverse support members 13 are positioned above and below circular openings 16. Circular openings 16 enable fasteners, such as a nut and bolt (not shown), to pass through circular openings 16 in order to attach, side panel to side panel, a plurality of filter frames across the width of the inlets wider in span than a single filter frame (FIG. 4).

The filters claimed herein are easily adaptable to provide full coverage of inlets having a width greater than that of the filter frame 10, 310. In FIG. 4, a plurality of filter frames 10, having a single end cap chamber 11, are removably attached side panel to side panel along curbside gutter 20, across inlet 30. In this manner, only the end cap chambers 11 at each terminal end 17 of the inlet 30, and filter chambers 4 are filled with gravel. The remaining end cap chamber(s) 11 remains gravel free so that a hydraulic opening is maintained across inlet 30.

The filter frame is designed so that it can be made of one work piece in one plastic injection mold cycle. In this case, the primary baffle panel 6 and the overflow baffle panel(s) 7 are constructed of a second work piece in a second injection cycle to be rigidly inserted within filter frame 10, 310 and connected to the side panels 15, 315 and back panel 8 by means of a channel, rivet, wire or clip.

What is claimed is:

1. In a storm water drainage basin system comprising a below ground receiving basin and a recessed curb inlet for receiving water, the improvement consisting of a portable sediment filter disposed adjacent to, and external of, said curb inlet, said filter comprising a mesh box filter frame having a rectangular bottom panel, a rectangular front panel, and two side panels, wherein a mesh primary baffle divides the filter frame into a filter chamber containing a particulate filter medium and an overflow chamber, said overflow chamber being divided into a hydraulic opening and an end cap chamber by a mesh overflow baffle.

2. The system as recited in claim 1 wherein the side panels and the overflow baffle panel are each at an acute angle at the lower ends thereof to the back panel.

3. The system as recited in claim 1 wherein the side panels and the overflow baffle panel are each substantially perpendicular at the lower ends thereof to the back panel.

4. The system as recited in claim 1 wherein the filter means is gravel.

5. The system according to claim 1 wherein the frame, and the primary and the overflow baffle panels are constructed of injection molded plastic.

6. The system as recited in claim 5 wherein the filter frame is made of one work piece and the primary baffle panel and the overflow baffle panel are made of a second work piece.

7. The filter as recited in claim 5 wherein the side panels each have an upper aperture whereby a handle is formed between the upper edge of the side panels and the upper periphery of the aperture.

8. The system as recited in claim 7 wherein the side panels are each provided with a pair of circular openings.

9. The system as recited in claim 8 wherein the side panels are each provided with a first transverse support member above the circular openings and a second transverse support member below the circular openings.

* * * * *